US006876138B2

(12) United States Patent
Baek

(10) Patent No.: US 6,876,138 B2
(45) Date of Patent: Apr. 5, 2005

(54) CRT WITH FUNNEL HAVING QUADRANGULAR YOKE PORTION

(75) Inventor: Jae-Seung Baek, Chilgok (KR)

(73) Assignee: LG. Philips Displays Korea Co., Ltd., Seoul (KR)

( * ) Notice: Subject to any disclaimer, the term of this patent is extended or adjusted under 35 U.S.C. 154(b) by 10 days.

(21) Appl. No.: 10/154,821

(22) Filed: May 28, 2002

(65) Prior Publication Data

US 2003/0168963 A1 Sep. 11, 2003

(30) Foreign Application Priority Data

Mar. 7, 2002 (KR) ..... 2002-12228

(51) Int. Cl.[7] ..... H01J 29/00; H01J 31/00

(52) U.S. Cl. ..... 313/440; 313/477 R; 220/2.1 A; 220/2.3 A; 335/209; 335/296

(58) Field of Search ..... 313/441, 477 R, 313/440, 479, 326; 220/2.1 A, 202 A, 2.3 A; 335/209, 296; 252/62.51, 62.51 R; 348/829

(56) References Cited

U.S. PATENT DOCUMENTS 3,610,990 A * 10/1971 Yamazaki et al. ..... 313/404
4,535,907 A * 8/1985 Tokita et al. ..... 220/2.1 A
4,858,016 A * 8/1989 Suehiro et al. ..... 348/822
5,962,964 A 10/1999 Sano et al. ..... 313/440
6,160,343 A * 12/2000 Joung ..... 313/440
6,259,206 B1 * 7/2001 Tsuchiya et al. ..... 315/3
6,307,313 B1 * 10/2001 Fukuda ..... 313/421
6,384,525 B1 * 5/2002 Sano et al. ..... 313/440
6,534,908 B1 * 3/2003 Nose et al. ..... 313/477 R
6,541,902 B1 * 4/2003 Carpinelli et al. ..... 313/421
6,552,483 B1 * 4/2003 Cho et al. ..... 313/440
6,590,329 B2 * 7/2003 Tagami ..... 313/440

* cited by examiner

*Primary Examiner*—Ashok Patel
(74) *Attorney, Agent, or Firm*—Fleshner & Kim LLP

(57) ABSTRACT

In a color cathode ray tube, by optimizing an outer radios of curvature, an inner radius of curvature on a corner portion, a thickness of a long side, a thickness of a short side, a thickness of the corner portion, the total length of the panel, the total length of the funnel body and the total length of a yoke portion of the funnel determining a section shape of the yoke portion of the funnel, a stress concentrated on the yoke portion can be lowered. In addition, according to the increase of an inner radius of curvature of the corner portion of the yoke portion, a crash phenomenon of an electron beam is decreased, and an impact resistance and productivity improvement in fabrication process can be secured by lowering a high stress occurrence on the funnel in vacuum.

13 Claims, 7 Drawing Sheets

CRT WITH FUNNEL HAVING QUADRANGULAR YOKE PORTION

BACKGROUND OF THE INVENTION

1. Field of the Invention

The present invention relates to a color cathode ray tube, and in particular to a color cathode ray tube which is capable of lowering a stress occurred due to an internal vacuum pressure of a cathode ray tube by optimizing a structure of a funnel yoke portion.

2. Description of the Prior Art

As depicted in FIG. 1, the conventional color cathode ray tube includes a panel 10 in which a R, G, B fluorescent surface 40 is coated onto the internal surface and an explosion proof means is fixed to the front surface portion, a funnel 20 welded to the rear end of the panel 10, an electron gun 130 inserted into a neck portion 140 of the funnel 20 and radiating an electron beam 60, a deflection yoke 50 deflecting the electron beam 60, a shadow mask 70 installed inside the panel 10 with a certain interval and having a plurality of holes so as to pass the electron beam 60, a main frame 30 and a sub frame 35 fixedly-supporting the shadow mask 70 in order to make the shadow mask 70 maintain a certain distance from the internal surface of the panel 10, a spring 80 for connecting-supporting the frame and panel 30, an inner shield 90 shielding the cathode ray tube against the external earth magnetic field and a reinforcing band 110 installed to the side circumferences of the panel 10 in order to prevent external impacts.

And, a CPM (convergence purity magnet) 100 for adjusting a proceeding trajectory of the electron beam 60 so as to make it land on a target fluorescent accurately is included in order to prevent a color purity defect.

A general fabrication process of the conventional color cathode ray tube can be divided into the first half process and the latter half process, the first half process is coating a fluorescent surface onto the internal surfaces of the panel 10, and the latter half process consists of below several processes.

First, in a sealing process, the panel 10 in which the fluorescent surface is coated and includes a mask assembly is joined to the funnel 20 in which frit is coated onto the sealing surface. After that, in an enclosing process, the electron gun 130 is inserted into the neck portion 140 of the funnel 20. And, in an exhausting process the cathode ray tube is sealed after vacuumizing internal space of the cathode ray tube.

Herein, when the cathode ray tube is in the vacuum state, a high tensile force and a high compressive stress act on the panel 10 and the funnel 20.

Accordingly, after the exhausting process, in order to disperse the high stress acting on the front surface of the panel 10, a reinforcing process for adhering the reinforcing band 100 is performed.

Recently, with digitalization, a cathode ray tube has been slimmed down by reducing the total length.

In more detail, the less the total length of a glass of the panel 10, the more a volume of the cathode ray tube decreases. However, a vacuum quantity is constant, accordingly the less the volume of the cathode ray tube, the more stress acts on the glass.

In addition, when the total length of the cathode ray tube is reduced, because a high stress acts on the funnel 20 having a thinner thickness than that of the panel 10, particularly a high tensile stress acts on a seal line portion at which the panel 10 and the funnel are joined, the color cathode ray tube may easily damaged in a thermal process.

In more detail, as depicted in FIG. 2, the total length of the cathode ray tube can be reduced by reducing the total length of the panel 10 or reducing the total length of a body portion 160.

However, when the total length of the panel 10 is reduced, because a high tensile stress occurs on the seal line portion due to vacuum after the exhausting process and a width of the reinforcing band 110 is limited due to decrease of a space for combining it, accordingly a stress disperse effect is reduced.

FIG. 3 illustrates a distribution of stress acting on the panel 10 and the funnel 20 when the inside the cathode ray tube is in the vacuum state after the exhausting process, a dotted line describes a compressive stress, and a tensile stress describes a tensile stress.

When the glass in which the panel 10 and the funnel 20 are combined a receives an external impact and a crack occurs. Herein, the tensile stress applied to the glass surface accelerates proceeding of the crack, the glass may be totally broken in the worst case.

On the contrary, the compressive stress prevents proceeding of a crack.

In more detail, as depicted in FIG. 3, because the compressive stress acts on the central portion 11 of the panel 10, the skirt central portion 12 and the central portion 21 of the funnel 20, they are relatively strong to impacts. However, because the tensile stress acts on the corner portion of the panel 10 and the seal line portion 14, they are sensitive to impacts.

In addition, as depicted in FIG. 4, the compressive stress acts on a long side 151 and a short side 152 of the funnel yoke portion 150. On the contrary, the tensile stress acts on the corner portion 153, it can be damaged by a weak impact.

Accordingly, in design of the glass, the tensile stress has to be sufficiently considered, in the conventional art, a limit stress value of the glass is not greater than 12 MPa.

Herein, in the funnel body portion 160, a stress can be efficiently lowered by using a certain ratio in fabrication of its shape or increasing a thickness locally. However, in the yoke portion 150, when a general shape in FIG. 4 is applied, a tensile stress of 15~20 MPa in FIG. 5 acts on, it is impossible to reduce the stress efficiently with a glass having a limit stress value as 12 MPa. In addition, because a high stress occurs, there are lots of difficulties in fabrication processes.

In addition, in order to secure an impact resistance of the glass, a reinforced glass having an improved physical strength at its surface by performing a thermal process besides installing the reinforcing band 110 is used or a film is coated onto the surface of the panel 10, etc.

However, all the above-described methods are for the panel 10, in the funnel 20, it has little effect in a reinforcing band installation, and in general the funnel 20 does not use a reinforced glass passing a reinforcing thermal process as its material.

In addition, when a glass thickness of the funnel yoke portion 150 increases, a tensile stress on the portion decreases, however a shade occurs on the screen at which the fluorescent surface 40 is coated when the electron beam 60 hits the internal surface of the yoke portion 150, there is limitation to increase a glass thickness.

Accordingly, mechanical techniques capable of securing an impact resistance and lowering a stress on the yoke portion 150 of the funnel 20 are required.

SUMMARY OF THE INVENTION

Accordingly, it is an object of the present invention to provide a color cathode ray tube which is capable of lowering efficiently a stress on a funnel due to an internal vacuum pressure by optimizing a structure of a funnel yoke portion.

In order to achieve the above-mentioned object, in a color cathode ray tube including a panel having an internal fluorescent surface, a funnel placed inside the panel and sealed in vacuum, an electron gun discharging an electron beam radiating the fluorescent surface, a shadow mask for making the electron beam from the electron gun land on a certain portion of the fluorescent surface, a frame for fixing/supporting the shadow mask, a spring combining the frame assembly with the panel, an inner shield installed to a certain side of the frame from the panel side to the funnel side in order to protect the cathode ray tube against an external earth magnetic field, an electron gun placed at the inner surface of a neck portion of the funnel and generating an electron beam, a deflection yoke placed at the outer surface of the neck portion of the funnel and deflecting the electron beam from the electron gun toward a certain direction, a CPM (convergence & purity magnet) for adjusting precisely the deflection direction of the electron beam and a reinforcing band installed to the outer circumference at which the panel is combined with the funnel in order to protect the panel and the funnel from an air atmosphere and external impacts, wherein a section shape of the yoke portion is quadrangular at which a corner portion has a certain radius of curvature, and it satisfies Rdi/Rdo>0.775 when an outer radius of curvature at the corner portion is Rdo and an inner radius of curvature is Rdi.

In addition, in a color cathode ray tube including a panel having an internal fluorescent surface, a funnel placed inside the panel and sealed in vacuum, an electron gun discharging an electron beam radiating the fluorescent surface, a shadow mask for making the electron beam from the electron gun land on a certain portion of the fluorescent surface, a frame for fixing/supporting the shadow mask, a spring combining the frame assembly with the panel, an inner shield installed to a certain side of the frame from the panel side to the funnel side in order to protect the cathode ray tube against an external earth magnetic field, an electron gun placed at the inner surface of a neck portion of the funnel and generating an electron beam, a deflection yoke placed at the outer surface of the neck portion of the funnel and deflecting the electron beam from the electron gun toward a certain direction, a CPM (convergence & purity magnet) for adjusting precisely the deflection direction of the electron beam and a reinforcing band installed to the outer circumference at which the panel is combined with the funnel in order to protect the panel and the funnel from an air atmosphere and external impacts, wherein a section shape of the yoke portion is quadrangular at which the corner portion has a certain radius of curvature, and it satisfies $$0.6 \leqq PL/BL \leqq 1.6, \text{ and}$$

$$Dt \leqq 3$$

when the total length of the panel is PL, a distance from a seal line at which the panel and the funnel meet to the yoke line of the funnel on the tube axis is BL, a distance from the yoke line to the neck line on the tube axis is YL, a thickness of the corner portion of the yoke portion is Dt, a thickness of a long side of the yoke portion is Lt, and a thickness of a short side of the yoke portion is St.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
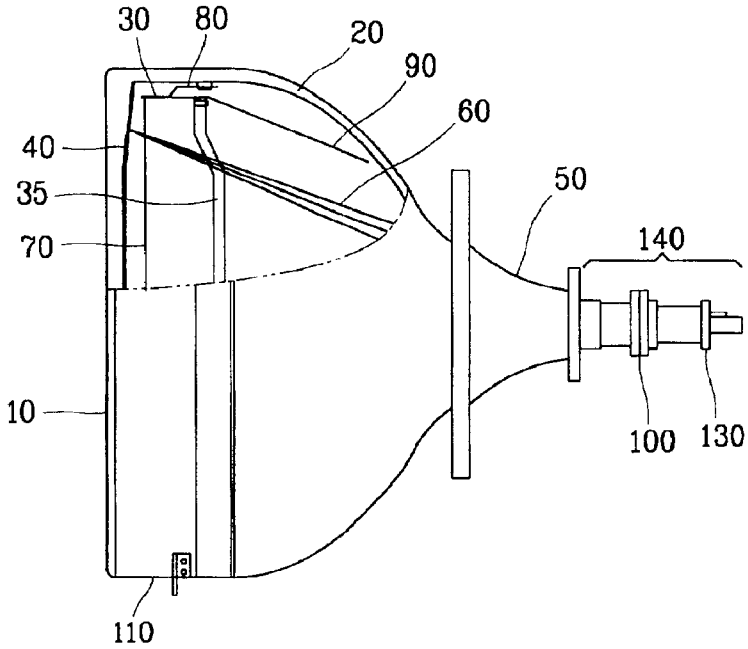
FIG. 1 CONVENTIONAL ART
FIG. 1 is a structure map of a general cathode ray tube.

Hereinafter, the preferred embodiment of the present invention will be described with reference to accompanying drawings.

The same parts as those of the conventional art have the same reference numerals, explanation about them will be abridged.

As described above, in the conventional funnel, particularly, in the funnel 20 having a short length, a high stress concentration occurs diagonally on a radius of curvature of the seal line at which the panel 10 and the funnel 20 are combined and the funnel yoke portion 150.

The diagonal radius of curvature means the quadrangular corner portion at the yoke portion 150 having a rough quadrangle section in which a vertical surface with respect to the tube axis is cut.

A yoke line means a line in which the deflection yoke 50 for deflecting an electron beam can be placed toward the panel 10 to the utmost.

Herein, a stress acting on the seal line can be efficiently lowered by increasing a glass thickness, in the yoke portion 150 of the funnel 20, when a glass thickness is increased, a tensile stress on the portion is decreased, however because the electron beam 60 crashes to the internal surface of the yoke portion 150, a shade occurs on the screen. Accordingly, there is limit to increase a glass thickness.

Accordingly, by lowering a stress acting on the yoke portion, the present a invention can secure not only an impact resistance but also a yield rate in fabrication process.

Figure 6:
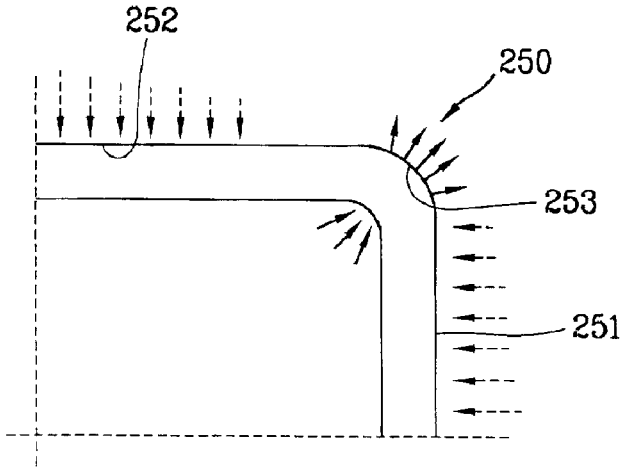
FIG. 6 illustrates a shape of a funnel yoke portion in accordance with the present invention.
Figure 7A:
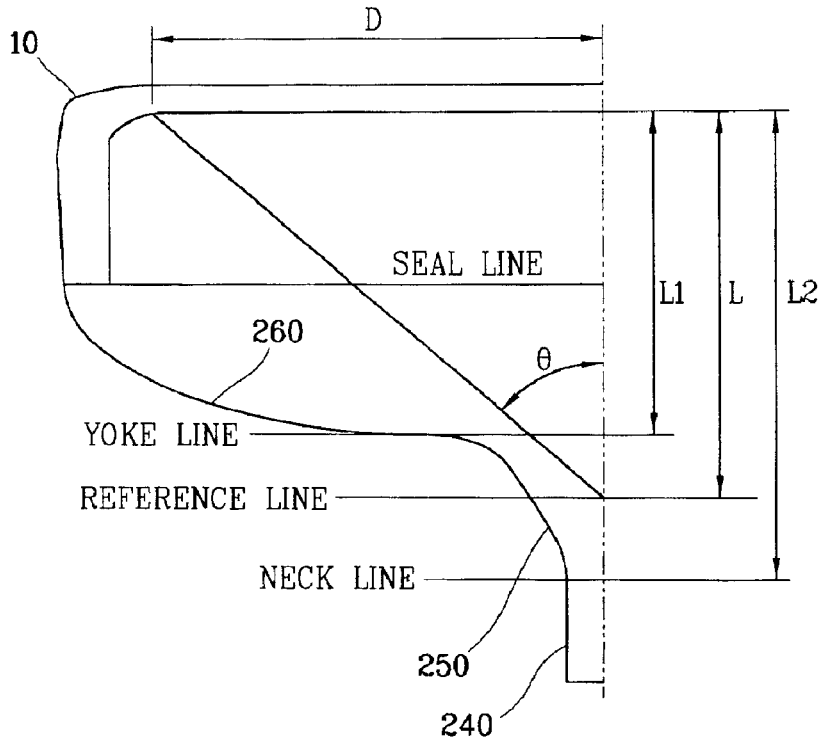
FIG. 7A is a schematic view illustrating major parts of the present invention.
Figure 7B:
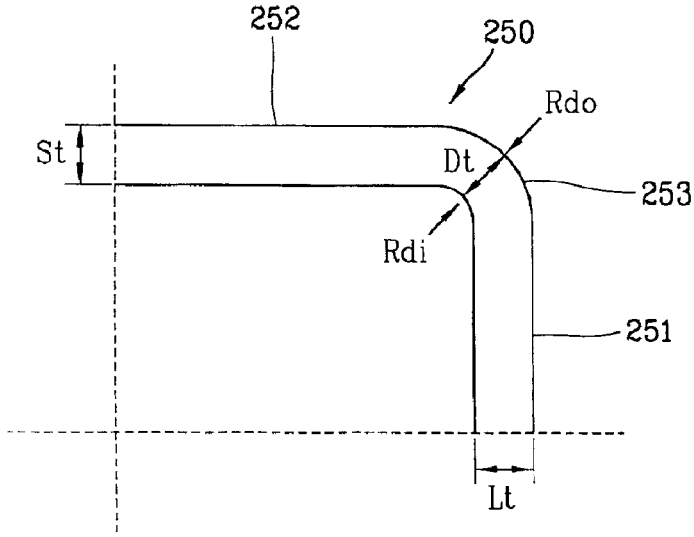
FIG. 7B is a schematic view illustrating major parts of the present invention.

FIG. 6 illustrates ¼ section in a shape of a funnel yoke portion 250 in accordance with the present invention when its vertical section is cut with respect to the tube axis. FIGS. 7A and 7B illustrate parts and factors for describing a structure of the present invention.

As depicted in FIG. 6, in a rough quadrangular shape, the funnel yoke portion 250 consists of a long side 251 distant from the tube axis, a short side 252 near to the tube axis and a corner portion 253 formed at which the long side 521 meets with the short side 252.

And, as depicted in FIG. 7A, it is defined that a distance from the internal surface of the panel 10 to a reference line is L, a distance from the internal surface of the panel 10 to the yoke line of the funnel is L1, a distance from the internal surface of the panel 10 to the neck line of the funnel is L2, and ½ of an effective surface diagonal length of the screen is D.

In FIG. 7A, a non-described reference numeral 240 is a funnel neck portion, 250 is a funnel yoke portion, and 260 is a funnel body portion.

In addition, as depicted in FIG. 7B, it is defined a corner portion thickness of the yoke portion vertical section is Dt, a long side thickness of the yoke portion is Lt, and a short side thickness of the yoke portion is St.

In FIG. 7B, a non-described reference numeral 251 is a long side of the yoke portion 250, 252 is a short side of the yoke portion 250, and 253 is a corner portion of the yoke portion 250.

In the present invention, by adjusting a thickness of the long side 251 and a thickness of the short side 252 of the funnel yoke portion 250, a high stress applied to the yoke portion 250 can be lowered.

First, by measuring stress distribution applied to the corner portion 253 of the yoke portion 250 while varying an external radius of curvature (Rdo) and an internal radius of curvature (Rdi) of the corner portion 253 of the yoke portion 250, an optimum design value can be obtained.

Figure 8:
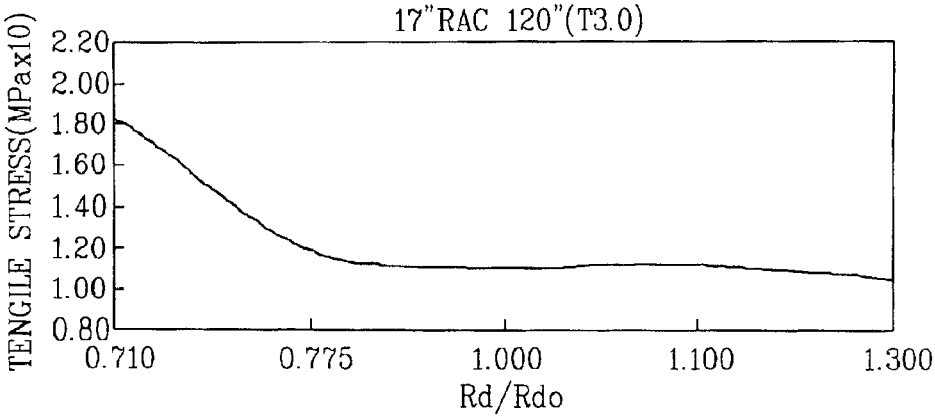
FIG. 8 illustrates a tensile stress applied to a corner portion of a yoke portion according to Rdi/Rdo values.

FIG. 8 illustrates a tensile stress applied to the corner portion 253 of the yoke portion 250 according to Rdi/Rdo values in a 17 inches cathode ray tube having a deflection of 120°. As depicted in FIG. 8, when Rdi/Rdo<0.775, a tensile stress applied to the corner portion 253 of the funnel yoke portion 250 exceeds a limit stress of 12 MPa.

Accordingly, Rdi and Rdo applied to the present invention have to satisfy a below Equation 1.

$$Rdi/Rdo>0.775 \qquad \text{Equation 1}$$

In addition, the greater a difference between an internal and external radius curvatures, the more a breakage rate in a thermal process increases. In consideration of the breakage rate in the thermal process and a shape of the funnel 20, it is preferable to satisfy a below Equation 2.

$$0.9<Rdi/Rdo<1.1 \qquad \text{Equation 2}$$

Figure 9A:
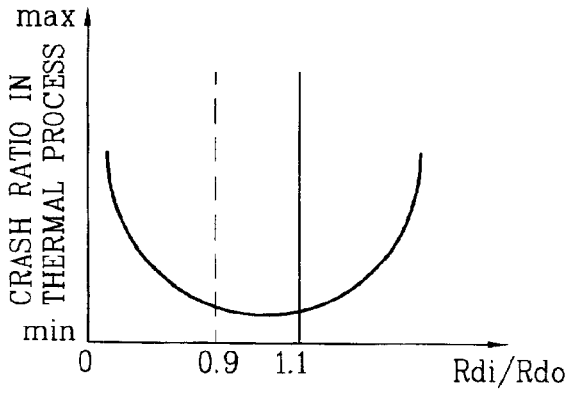
FIG. 9A is a graph illustrating a plasticity according to Rdi/Rdo values.
Figure 9B:
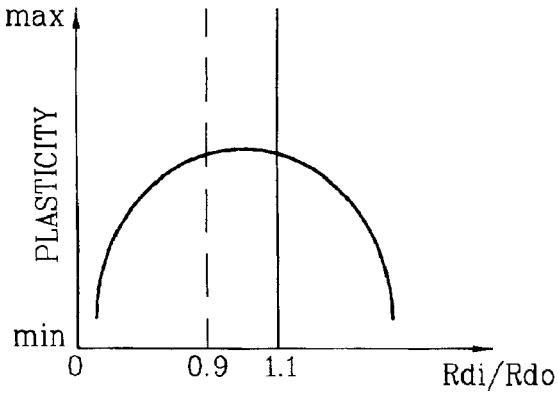
FIG. 9B is a graph illustrating a breakage rate in a thermal process according to Rdi/Rdo values.

FIGS. 9A and 9B respectively illustrate a plasticity and a breakage rate in the thermal process according to the Rdi/Rdo values.

In addition, the more the inner radius of curvature (Rdi) increases, the more easily a shade occurrence phenomenon on the screen due to clash of the electron beam 60 to the funnel yoke portion 250 is reduced and a tensile stress applied to the corner portion 253 of the funnel yoke portion 250 is reduced, accordingly thermal process and impact resistance characteristics can be improved, and a plasticity can be improved.

However, because the inner radius of curvature can not be increased infinitely, and it is most preferable the inner radius of curvature (Rdi) is same as the outer radius of curvature (Rdo), namely, Rdi/Rdo=1.

Alike the inner radius of curvature (Rdi), the more the outer radius of curvature (Rdo) increases, the more easily a tensile stress acting on the corner portion 253 of the funnel yoke portion 250 is reduced, accordingly thermal process, impact resistance and plasticity can be improved. However, the more the outer radius of curvature (Rdo) increases, the more a sensitivity of the deflection yoke 50 is lowered, accordingly it is preferable to satisfy a range of 7<Rdo<13.

In addition, the reference line is a base line for designing the funnel 20, and it is invisible in eyesight.

In general, in an electron beam deflection by the deflection yoke 50, a position of the reference line is defined as the deflection center, it is flexibly determined around the center on the tube axis of the funnel yoke portion 250.

Accordingly, when the total height of the funnel yoke portion 250 is 100, a position of the reference line is placed within a range of ±5 on the basis of the center of the funnel yoke portion 250.

In more detail, a length L on the tube axis from the internal surface of the panel 10 to the reference line satisfies below Equation 3, and a relation between L and D determining a deflection angle θ satisfies below Equation 4.

$$L1+(L2-L1)\times 0.45 \leqq L \leqq L1+(L2-L1)\times 0.55 \qquad \text{Equation 3}$$

$$\theta=\mathrm{Tan}^{-1}(D/L)>1.1 \qquad \text{Equation 4}$$

In particular, in Equation 4, it is preferable $\mathrm{Tan}^{-1}(D/L)>1.15$.

Figure 2:
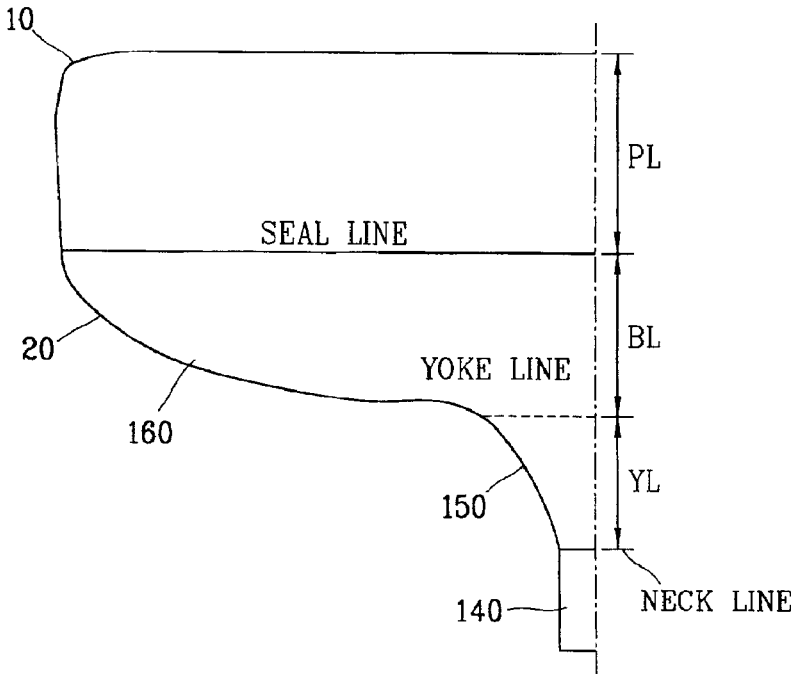
FIG. 2 CONVENTIONAL ART
FIG. 2 is a schematic view defining major parts of a panel and a funnel glass.
Figure 3:
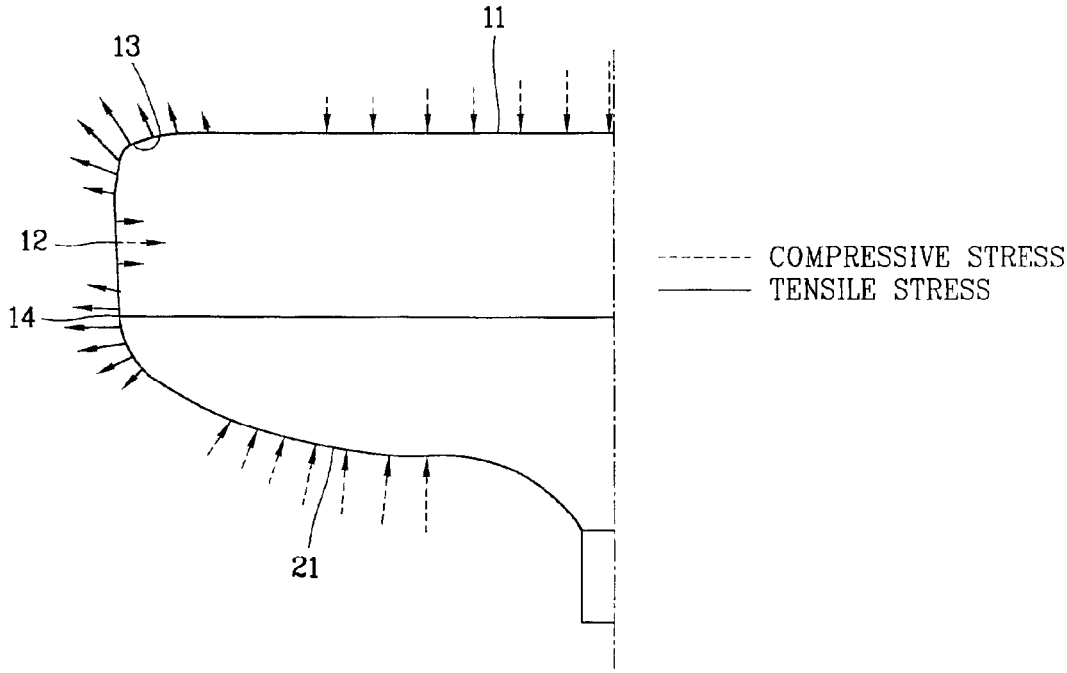
FIG. 3 CONVENTIONAL ART
FIG. 3 is a schematic view illustrating a stress distribution inside the conventional cathode ray tube in vacuum.
Figure 4:
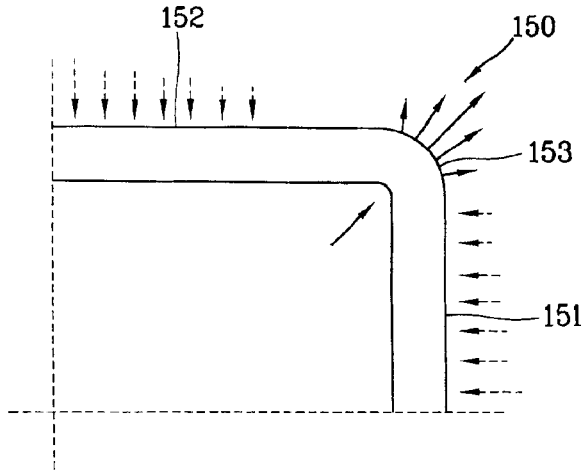
FIG. 4 CONVENTIONAL ART
FIG. 4 is a schematic view illustrating a stress distribution on the conventional funnel yoke portion.

In addition, in FIG. 2, a relation between the funnel body total length (BL) and the panel total length (PL) satisfies below Equation 5, and in FIG. 7B a thickness Dt of the corner portion 253 of the funnel yoke portion 250 satisfies below Equation 6.

$$0.6 \leqq PL/BL \leqq 1.6 \qquad \text{Equation 5}$$

$$Dt \geqq 3 \qquad \text{Equation 6}$$

It is preferable to satisfy Dt≦St, Dt≦Lt, St>4, Dt>4 and BL≦YL.

In addition, when a relation between the funnel body total length (BL) and the panel total length (PL) satisfies below Equation 7, a stress can be reduced more efficiently.

$$0.8 \leqq PL/BL \leqq 1.3 \qquad \text{Equation 7}$$

Figure 10A:
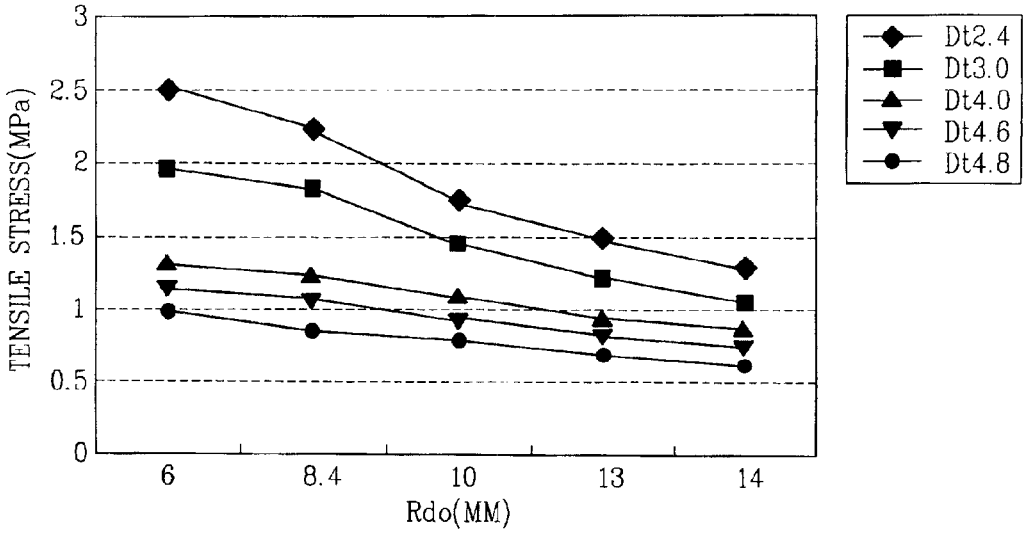
FIG. 10A is a graph illustrating a tensile stress decrease according to Rdo and Dt.
Figure 10B:
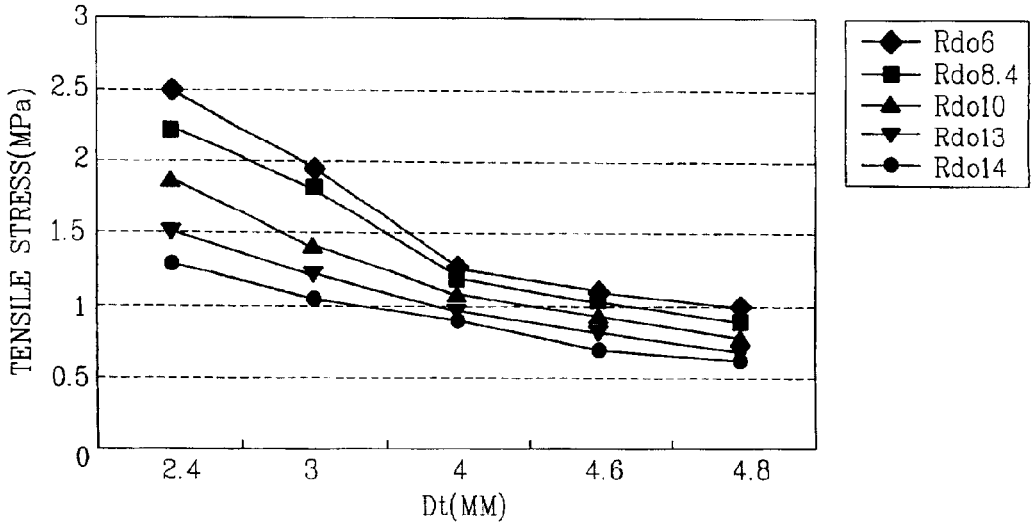
FIG. 10B illustrates a tensile stress decrease according to Rdo and Dt.

In the meantime, in Table 1, FIGS. 10A and 10B, a tensile stress decrease according to the outer radius of curvature (Rdo) and the thickness (Dt) of the corner portion 253 of the funnel yoke portion 250.

TABLE 1

Unit: MPa

| | Rdo[mm] | | | | |
|---|---|---|---|---|---|
| Dt[mm] | 6.0 | 8.4 | 10.0 | 13.0 | 14.0 |
| 2.4 | 2.52 | 2.23 | 1.76 | 1.48 | 1.28 |
| 3.0 | 1.96 | 1.83 | 7.45 | 1.22 | 1.05 |

TABLE 1-continued

| Unit: MPa | | | | | |
|---|---|---|---|---|---|
| | Rdo[mm] | | | | |
| Dt[mm] | 6.0 | 8.4 | 10.0 | 13.0 | 14.0 |
| 4.0 | 1.25 | 1.19 | 1.07 | 0.96 | 0.91 |
| 4.6 | 1.10 | 1.03 | 0.90 | 0.82 | 0.70 |
| 4.8 | 0.98 | 0.88 | 0.80 | 0.71 | 0.63 |

As depicted in FIG. 10A, the less a thickness (Dt) of the corner portion 253 of the funnel yoke portion 250, the more a tensile stress reduction rate according to an outer radius of curvature (Rdo) increases.

In more detail, the less a thickness (Dt) of the corner portion 253 of the funnel yoke portion 250, the more the influence of the outer radius of curvature (Rdo) on the tensile stress reduction increases.

In addition, as depicted in FIG. 10B, when the thickness (Dt) of the corner portion 253 of the funnel yoke portion 250 is not grater than 4 mm, it is efficient to reduce the tensile stress ratio regardless of the outer radius of curvature, when the thickness (Dt) of the corner portion 253 of the funnel yoke portion 250 is not less than 4 mm, the tensile stress reduction ratio is similar regardless of the outer radius of curvature.

Figure 5:
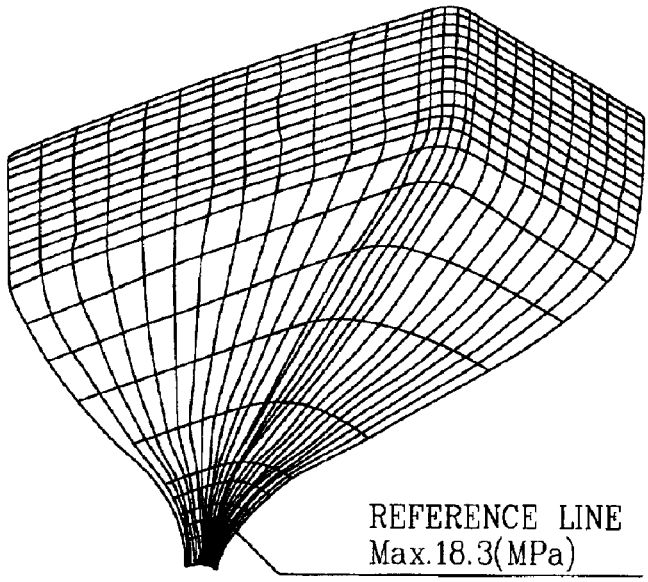
FIG. 5 CONVENTIONAL ART
FIG. 5 illustrates a maximum stress value on the conventional funnel yoke portion.
Figure 11:
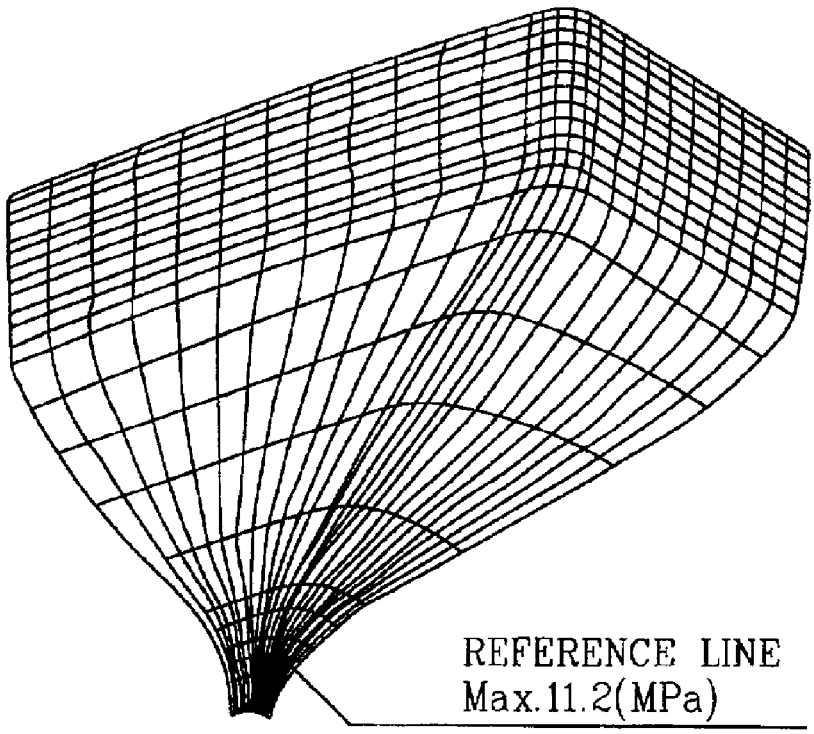
FIG. 11 illustrates a maximum stress value occurred on the funnel yoke portion in accordance with present invention.

And, when the simulation result of the present inventions is compared with that of the conventional art, in the conventional art as depicted in FIG. 5, a maximum stress on the funnel yoke portion 150 is 18.3 MPa exceeding 12 MPa as a limit stress value of a glass. However, in the present invention as depicted in FIG. 11, a maximum stress on the funnel yoke portion 250 is 11.2 MPa lower than 39% in the comparison with the conventional art, a stress concentrated on the outer surface of the corner portion 253 of the funnel yoke portion 250 in vacuum is dispersed to the right and the left.

The experiments are performed with a cathode ray tube having an angle θ of 50~70° with respect to the tube axis in which a straight line connects the diagonal angle effective surface end to a cross point of the reference line on the tube axis, but the present invention can be also applied to other cathode ray tubes not included in that range.

As described above, by adjusting a radius and a thickness of curvature on a corner portion of a funnel yoke portion, a stress concentration on the yoke portion can be prevented.

In addition, according to the increase of an inner radius of curvature of the corner portion of the yoke portion, a crash phenomenon of an electron beam is decreased, and an impact resistance and a yield rate in fabrication process can be secured by lowering a high stress occurrence on the funnel in vacuum.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color cathode ray tube comprising:

a panel having an internal fluorescent surface;

a funnel coupled to the panel and sealed in vacuum;

a shadow mask for making the electron beam from the electron gun land on a certain portion of the fluorescent surface;

a frame for fixing/supporting the shadow mask;

a spring combining the frame assembly with the panel;

an inner shield installed to a certain side of the frame from the panel side to the funnel side in order to protect the cathode ray tube against an external earth magnetic field;

an electron gun placed at the inner surface of a neck portion of the funnel and generating an electron beam;

a deflection yoke placed at the outer surface of the neck portion of the funnel and deflecting the electron beam from the electron gun toward a certain direction; and a CPM (convergence & purity magnet) for adjusting precisely the deflection direction of the electron beam and a reinforcing band installed to the outer circumference at which the panel is combined with the funnel in order to protect the panel and the funnel from an air atmosphere and external impacts;

wherein a cross sectional shape of the yoke portion is quadrangular at which a corner portion has a radius of curvature that satisfies Rdi/Rdo>0.775 when an outer radius of curvature at the corner portion is Rdo and an inner radius of curvature at the corner portion is Rdi;

wherein an angle of a straight line connecting a diagonal angle effective surface end to a cross point of a reference line on the tube axis is 50~70° with respect to the tube axis when the reference line is defined as an imaginary line passing through a deflection center of the deflection yoke and perpendicular to the tube axis; and wherein the color cathode ray tube satisfies 7(mm) <Rdo<13(mm).

2. The color cathode ray tube of claim 1, wherein a relation between the Rdi and the Rdo satisfies 0.9<Rdi/Rdo<1.1.

3. The color cathode ray tube of claim 2, wherein Rdi/Rdo=1.

4. The color cathode ray tube of claim 1, wherein the color cathode ray tube satisfies $$L1+(L2-L1)\times 0.45 \leqq L \leqq L1+(L2-L1)\times 0.55,$$

$$\mathrm{Tan}^{-1}(D/L)>1$$

when a distance from the internal surface of the panel 10 to the reference line on the tube axis is L, a distance from the internal surface of the panel to a yoke line of the funnel is L1, a distance from the internal surface of the panel to a neck line of the funnel is L2 and ½ of a diagonal length of a screen is D.

5. The color cathode ray tube of claim 4, wherein the color cathode ray tube satisfies $\mathrm{Tan}^{-1}$ (D/L)>1.15.

6. A color cathode ray tube, comprising:

a panel having an internal fluorescent surface; and a funnel coupled to the panel, wherein the funnel comprises, a deflection yoke portion and a neck portion, wherein the color cathode ray rube satisfies $$L1+(L2-L1)\times 0.45 \leqq L \leqq L1+(L2-L1)\times 0.55,$$

$$\mathrm{Tan}^{-1}(D/L)>1$$

wherein a distance from the internal surface of the panel to a reference line on the tube axis is L, a distance from the internal surface of the panel to a yoke line of the funnel is L1, a distance from the internal surface of the panel to a neck line of the funnel is L2 and 2 of a diagonal length of a screen is D.

7. A color cathode ray rube, comprising:

a panel having an internal fluorescent surface; and a funnel coupled to the panel, wherein the funnel comprises, a deflection yoke portion and a neck portion, wherein a section shape of the yoke portion is quadrangular at which a corner portion has a radius of curvature that satisfies $$0.6 \leqq PL/BL \leqq 1.6, \text{ and}$$

$$Dt \leqq 3(\text{mm})$$

wherein the total length of the panel is PL, a distance from a seal line at which the panel and the funnel meet to a yoke line of the funnel on the tube axis is BL, a distance from the yoke line to a neck line on an axis of the color cathode ray tube is YL, a thickness of a corner portion of the yoke portion is Dt(mm), a thickness of a long side of the yoke portion is Lt(mm), and a thickness of a short side of the yoke portion is St(mm).

8. In a color cathode ray tube including a panel having an internal fluorescent surface, a funnel placed inside the panel and sealed in vacuum, a shadow mask for making the electron beam from the electron gun land on a certain portion of the fluorescent surface, a frame for fixing/supporting the shadow mask, a spring combining the frame assembly with the panel, an inner shield installed to a certain side of the frame from the panel side to the funnel side in order to protect the cathode ray tube from external earth magnetic field, an electron gun placed at the inner surface of a neck portion of the funnel and generating an electron beam, a deflection yoke placed at the outer surface of the neck portion of the funnel and deflecting the electron beam from the electron gun toward a certain direction, a CPM (convergence & purity magnet) for adjusting precisely the deflection direction of the electron beam and a reinforcing band installed to the outer circumference at which the panel is combined with the funnel in order to protect the panel and the funnel from an air atmosphere and external impacts, wherein a section shape of the yoke portion is quadrangular at which the corner portion has a certain radius of curvature, and it satisfies $$0.6 \leqq PL/BL \leqq 1.6, \text{ and}$$

$$Dt \leqq 3(\text{mm})$$

when the total length of the panel is PL, a distance from a seal line at which the panel and the funnel meet to the yoke line of the funnel on the tube axis is BL, a distance from the yoke line to the neck line on the tube axis is YL, a thickness of the corner portion of the yoke portion is Dt, a thickness of a long side of the yoke portion is Lt, and a thickness of a short side of the yoke portion is St.

9. The color cathode ray tube of claim 8, wherein an angle of a straight line connecting the diagonal angle effective surface end to a cross point of the reference line on the tube axis is 50~70° with respect to the tube axis.

10. The color cathode ray tube of claim 8, wherein the color cathode ray tube satisfies $Dt \leqq St$ and $Dt \leqq Lt$.

11. The color cathode ray tube of claim 8, wherein the color cathode ray tube satisfies $St > 4(\text{mm})$ and $Dt > 4(\text{mm})$.

12. The color cathode ray tube of claim 8, wherein the color cathode ray tube satisfies $0.8 \leqq PL/BL \leqq 1.3$.

13. The color cathode ray tube of claim 8, wherein the color cathode ray tube satisfies $BL \leqq YL$.

* * * * *